US006735409B2

(12) United States Patent
Takahashi et al.

(10) Patent No.: US 6,735,409 B2
(45) Date of Patent: May 11, 2004

(54) PROCESS FOR DEVELOPING, IMAGE-FORMING APPARATUS, AND IMAGE-FORMING PROCESS CARTRIDGE

(75) Inventors: Hiroaki Takahashi, Sunto-gun (JP); Kimitoshi Yamaguchi, Numazu (JP); Naoki Imahashi, Mishima (JP); Akihiro Kotsugai, Numazu (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 10/339,290

(22) Filed: Jan. 10, 2003

(65) Prior Publication Data

US 2003/0143000 A1 Jul. 31, 2003

(30) Foreign Application Priority Data

Jan. 11, 2002 (JP) ..... 2002-004736

(51) Int. Cl.[7] ..... G03G 15/09; G03G 15/08
(52) U.S. Cl. ..... 399/267; 430/108
(58) Field of Search ..... 399/267, 252; 430/105, 106.6, 107, 108

(56) References Cited

U.S. PATENT DOCUMENTS

| | | | | |
|---|---|---|---|---|
| 4,990,425 | A | | 2/1991 | Nanya et al. |
| 5,079,123 | A | | 1/1992 | Nanya et al. |
| 5,085,965 | A | | 2/1992 | Nanya et al. |
| 5,102,766 | A | | 4/1992 | Nanya et al. |
| 5,288,577 | A | | 2/1994 | Yamaguchi et al. |
| 5,368,972 | A | | 11/1994 | Yamashita et al. |
| 5,418,103 | A | | 5/1995 | Muto et al. |
| 5,429,901 | A | | 7/1995 | Muto et al. |
| 5,532,804 | A | * | 7/1996 | Hirata et al. ..... 399/267 |
| 5,912,100 | A | | 6/1999 | Aoki et al. |
| 6,004,715 | A | | 12/1999 | Suzuki et al. |
| 6,010,814 | A | | 1/2000 | Kotsugai et al. |
| 6,168,894 | B1 | | 1/2001 | Aoki et al. |
| 6,472,118 | B1 | | 10/2002 | Yamaguchi et al. |
| 6,489,073 | B2 | | 12/2002 | Kotsugai et al. |

FOREIGN PATENT DOCUMENTS

| | | |
|---|---|---|
| JP | 6-110255 | 4/1994 |
| JP | 2001-117287 | 4/2001 |
| JP | 2001-117288 | 4/2001 |
| JP | 2002-229273 | 8/2002 |

* cited by examiner

*Primary Examiner*—Quana Grainger
(74) *Attorney, Agent, or Firm*—Oblon, Spivak, McClelland, Maier & Neustadt, P.C.

(57) ABSTRACT

A process for developing which includes the step of developing a latent electrostatic image on a latent electrostatic image support by a developing agent supplied on a development sleeve, where the developing agent is supplied with a density of 1.3 g/cm$^3$ to 2.0 g/cm$^3$ at the closest part between the support and the sleeve, the support is contacted with magnetic brushes formed of the developing agent on the sleeve, so that the magnetic brushes have a width of 2 mm or less at a linearly contacting surface, in a direction where the surface rotates and the developing agent contains toners, and carriers having magnetic core particles and resin layers to cover its surface, the carriers have a weight average particle diameter of 25 $\mu$m to 45 $\mu$m, contain 60 wt % or more of the particles having a diameter of less than 44 $\mu$m, and 7 wt % or less of particles having a diameter of less than 22 $\mu$m.

17 Claims, 4 Drawing Sheets

PROCESS FOR DEVELOPING, IMAGE-FORMING APPARATUS, AND IMAGE-FORMING PROCESS CARTRIDGE

BACKGROUND OF THE INVENTION

1. Field of the Invention

The present invention relates to a process for developing, an image-forming apparatus, and an image-forming process cartridge.

2. Description of the Related Art

A process for dry electrophotography is classified into the one-component developing process, where toners are charged by a development sleeve, a blade, or the like; and the two-component developing process, where toners are charged by carriers. The two-component developing process is mainly used for a medium to high-speed machines, because the two-component developing process provides more stably and uniformly charged toners, and provides more toners than the one-component developing process.

A carrier plays a role of charging a toner and of transporting the toner to a developing part. Properties of carrier significantly influences image-forming, and influences creating an image with high quality, accordingly.

Of carrier properties, the electrical resistance of the carrier also has a large influence on developing performance. The low electrical resistance of the carriers leads to a similar result to approaching a development electrode. A carrier having a low electrical resistance is more likely to develop a solid image, compared with a carrier having a high electrical resistance. A carrier having a relatively low electrical resistance is therefore used for a color copier, compared to a monochrome copier, which is required to reproduce letters and fine lines, for the purpose of higher development properties for a solid image.

The electrical resistance of the coated carrier depends not only on the electrical resistances of a material for the coating layer and a carrier core material, but also on a thickness of the coating layer. The thicker a coating layer, the larger an electrical resistance of the carrier. The electrical resistance of a carrier becomes constant, when the layer has more than a certain thickness.

Even among coated carriers whose electrical resistance are adjusted, the electrical resistances of the carriers vary over time due to a stress such as stirring inside a developer, and due to the fact that a coating layer of the carriers are thereby eroded.

The amount of toners to be developed varies over time, and a quality of an image also vary, accordingly.

The changes and differences in development performance cause problems for a quality of an image.

There are methods for stabilizing a developing performance over time, in which a coating film is strengthened, and electric resistances of carriers are lessened. Japanese Patent Application Laid-Open (JP-A) No. 06-110255, No. 2001-117287, No. 2001-117288, No. 2002-229273, and the like disclose a process for strengthening a coating film. Apparatuses have been miniaturized, and photocopying has been speeded up. As a result, the amount of a developing agent is becoming lessened, and a liner velocity at a development sleeve is highly increased. Moreover, a carrier is more stressed, and a coating film is more likely to be eroded. A carrier having a stronger coating film is hence insufficient to stabilize a developing performance over time.

A process for stabilizing a developing performance has been desired, even if an electrical resistance of a carrier varies because of eroding of a coating film, rather than to stabilize a developing performance by strengthening a coating film of a carrier.

SUMMARY OF THE INVENTION

The inventors of the present invention have found out that image properties without an abnormal image can be obtained by supplying a developing agent at the closest part between the latent electrostatic image support and the development sleeve (which may be referred to as a developing part, hereinafter) to a high density, by narrowing a width at a linearly contacting surface of a plurality of magnetic brushes (which may be referred to as a width at a linearly contacting surface), by using carriers having a smaller diameter, and by narrowly distributing carrier particle diameters. Herein, the width at a linearly contacting surface indicates a length of the linearly contacting surface in a direction where the surface of the magnetic brushes rotates.

FIG. 1 shows one example of a process in which the developing agent is supplied to a high density, and FIG. 2 shows one example of a plurality of magnetic brushes formed by supplying according to a conventional process.

In conventional processes, as compared to processes for supplying at a high density, the magnetic brush, which is formed of a developing agent by magnetism, has a large gap, so the toners to be developed facing the gap extends over a wide region from a direction of development sleeve 1 (valley of a magnetic brush) where the developing electric field is weak, to the tip. Hence, the carriers are easily influenced by electrical resistances. On the other hand, when the developing agent is supplied into the developing part to high density, toners to be developed, which face the gap, are concentrated in a vicinity of a photoconductor 2 as a latent electrostatic image support, where the developing electric field is strong. Even if a low electrical resistance is not given to carriers, toners are more likely to be developed. The difference in a developing performance is less likely to appear.

However, if a developing agent is supplied at a high density, non-uniform concentration caused by a magnetic brush's scraping is more obviously occurs at a half-tone part. This is because a plurality of magnetic brushes strongly contacts a photoconductor as a latent electrostatic image support, and a portion of toners developed on the photoconductor 2 is scraped.

The inventors of the present invention are convinced that, even if a developing agent is supplied at a developing part to a high density, a process for developing and an image-forming apparatus that produces an image without non-uniform image density at a half-tone part can be obtained by narrowing the width at a linearly contacting surface, where toners are also scraped, to 2 mm or less, by forming a fine magnetic brush where toners and carriers are uniformly disposed in which carriers having a smaller diameter are used, and the carrier particle diameters are narrowly distributed.

An object of the present invention is to provide a stable developing performance against the change in an electrical resistance of carriers, and to provide a process for developing and an image-forming apparatus, both of which can produce an image with a good quality.

A process for developing according to the first aspect of the present invention comprises the step of developing a latent electrostatic image on a latent electrostatic image support by a developing agent supplied on a development sleeve, wherein the developing agent is supplied with a density of 1.3 g/cm$^3$ to 2.0 g/cm$^3$ at the closest part between the latent electrostatic image support and the development sleeve, the latent electrostatic image support is contacted with a plurality of magnetic brushes formed of the developing agent on the development sleeve, so that a plurality of the magnetic brushes have a width of 2 mm or less at a linearly contacting surface, in a direction where the linearly contacting surface of the magnetic brushes rotates, and the developing agent contains toners, and carriers which comprise magnetic core particles and resin layers to cover a surface of the magnetic core particles the carriers have a weight average particle diameter of 25 $\mu$m to 45 $\mu$m, the carriers contain 60% by weight or more of the carrier particles having a particle diameter of less than 44 $\mu$m, and 7% by weight or less of carrier particles having a particle diameter of less than 22 $\mu$m.

According to the second aspect of the present invention, there is provided the process for developing of the first aspect, wherein a developing gap is 0.4 mm or less, when the developing gap expresses a distance at the closest part between the latent electrostatic image support and the development sleeve.

According to the third aspect of the present invention, the process for developing of the first aspect further comprises the step of applying an alternating current voltage as a developing agent bias voltage.

According to the fourth aspect of the present invention, there is provided the process for developing of the first aspect, wherein the density of the developing agent is 1.3 g/cm$^3$ to 1.7 g/cm$^3$, at the closest part between the latent electrostatic image support and the development sleeve.

According to the fifth aspect of the present invention, there is provided the process for developing of the first aspect, wherein the carriers contain 75% by weight or more of the carrier particles having a particle diameter of less than 44 $\mu$m.

According to the sixth aspect of the present invention, there is provided the process for developing of the first aspect, wherein the carriers contain 3% by weight or less of the carrier particles having a particle diameter of less than 22 $\mu$m.

According to the seventh aspect of the present invention, there is provided the process for developing of the sixth aspect, wherein the carriers contain 1% by weight or less of the carrier particles having a particle diameter of less than 22 $\mu$m.

According to the eighth aspect of the present invention, there is provided the process for developing of the first aspect, wherein the magnetic core particles have a magnetic moment of 76 emu/g to 100 emu/g, in a magnetic field of 1000 Oe.

According to the ninth aspect of the present invention, there is provided the process for developing of the eighth aspect, wherein the magnetic core particles are one of Mn—Mg—Sr ferrite, Mn ferrite, and magnetite.

According to the tenth aspect of the present invention, there is provided the process for developing of the first aspect, wherein the carriers have a bulk density of 2.2 g/cm$^3$ or more.

According to the eleventh aspect of the present invention, there is provided the process for developing of the first aspect, wherein a ratio of a liner velocity (Vp) of the latent electrostatic image support to a liner velocity of the development sleeve (Vr) satisfies a relation of $1.2<(Vr/Vp)<2.2$.

According to the twelfth aspect of the present invention, there is provided the process for developing of the first aspect, wherein the toners have a charging amount of 30 $\mu$C/g or less.

According to the thirteenth aspect of the preset invention, there is provided the process for developing of the first aspect, wherein the resin layers of the carrier particles contain a silicone resin and an aminosilane coupling agent.

According to the fourteenth aspect of the present invention, an image-forming apparatus comprises a latent electrostatic image support, a charger which charges the latent electrostatic image support, a light irradiator which irradiates a light to the latent electrostatic image support charged by the charger imagewisely so as to form a latent electrostatic image, a developer which comprises a development sleeve facing the latent electrostatic image support, introduces a developing agent so as to form a plurality of magnetic brushes, provides the developing agent with the latent electrostatic image, and renders the latent electrostatic image visible so as to form a developed image, and a transfer, which transfers the developed image formed by the developer to a transfer medium, wherein the developing agent is supplied with a density of 1.3 g/cm$^3$ to 2.0 g/cm$^3$ at the closest part between the latent electrostatic image support and the development sleeve, the latent electrostatic image support is contacted with a plurality of the magnetic brushes on the development sleeve, so that a plurality of the magnetic brushes have a width of 2 mm or less at a linearly contacting surface, in a direction where the linearly contacting surface of the magnetic brushes rotates, and the developing agent contains toners, and carriers which comprise magnetic core particles and resin layers to cover a surface of the magnetic core particles, the carriers have a weight average particle diameter of 25 $\mu$m to 45 $\mu$m, the carriers contain 60% by weight or more of carrier particles having a particle diameter of less than 44 $\mu$m, and 7% by weight or less of carrier particles having a particle diameter of less than 22 $\mu$m.

According to the fifteenth aspect of the present invention, there is provided the image-forming apparatus of the fourteenth aspect, wherein the developing gap is 0.4 mm or less.

According to the sixteenth aspect of the present invention, an image-forming process cartridge comprises a latent electrostatic image support; and a developer which comprises a development sleeve facing the latent electrostatic image support, introduces a developing agent so as to form a plurality of magnetic brushes, provides the developing agent with the latent electrostatic image, and renders the latent electrostatic image visible so as to form a developed image, wherein the process cartridge is formed in a one-piece construction and is attachable to and detachable from an image-forming apparatus, the developing agent is supplied with a density of 1.3 g/cm$^3$ to 2.0 g/cm$^3$ at the closest part between the latent electrostatic image support and the development sleeve, the latent electrostatic image support is contacted with a plurality of the magnetic brushes on the development sleeve, so that a plurality of the magnetic brushes have a width of 2 mm or less at a linearly contacting surface, in a direction where the linearly contacting surface of the magnetic brushes rotates, and the developing agent contains toners, and carriers which comprise magnetic core particles and resin layers to cover a surface of the magnetic core particles, the carriers have a weight average particle diameter of 25 $\mu$m to 45 $\mu$m, the carriers contain 60% by weight or more of carrier particles having a particle diameter of less than 44 $\mu$m, and 7% by weight or less of carrier particles having a particle diameter of less than 22 $\mu$m.

According to the seventeenth aspect of the present invention, there is provided the image-forming process cartridge of the sixteenth aspect, wherein the developing gap is 0.4 mm or less.

DESCRIPTION OF THE PREFERRED EMBODIMENTS

In a process for developing according to the present invention, the developing agent is supplied with a density at the developing part of 1.3 g/cm$^3$ to 2.0 g/cm$^3$.

The amount of the introduced developing agent refers to the developing agent in weight per cm$^2$, in which the developing agent has passed a doctor blade without reaching the developing area, when the machine is forcibly stopped after the latent electrostatic image support 2 and development sleeve 1 are driven for 60 seconds at the speed of the process used.

To be more specific, a developing agent introduced onto a development sleeve is attracted by a magnet. The weight of the attracted amount of the developing agent is then measured. The weight is divided by the area of the development sleeve where the developing agent is disposed.

A density of the developing agent (expressed in "g/cm$^3$") is obtained by dividing the introduced amount of a developing agent (expressed in "g/cm$^2$") by a developing gap (expressed in "cm"). A narrower developing gap increases the density of the developing agent, even if the same amount of the developing agent is introduced.

The amount of the introduced developing agent is adjusted by blocking the developing agent with a doctor blade, so as to determine the amount of the developing agent. If the doctor gap (a width between the doctor blade and the development sleeve) is narrowed, a smaller amount of the developing agent passes the doctor blade. Accordingly, a smaller amount of the developing agent is introduced onto a development sleeve. The wider the doctor gap is, the more developing agent passes the doctor blade. Accordingly, more developing agent is introduced onto a development sleeve. Using a thickness gauge, the amount of the introduced developing agent is adjusted by adjusting the position of the doctor blade, so as to have a different width of the doctor gap.

The density of the developing agent at a developing part is preferably 1.3 g/cm$^3$ to 2.0 g/cm$^3$, and more preferably 1.3 g/cm$^3$ to 1.7 g/cm$^3$. If it is less than 1.3 g/cm$^3$, developing performance varies over time. If it is 1.3 g/cm$^3$ or more, developing performance varies less over time. Further, if it is more than 2.0 g/cm$^3$, a developing performance deteriorates, and non-uniform image density at the half tone part becomes apparent. Therefore, a preferable density is 2.0 g/cm$^3$ or less, and more preferably 1.7 g/cm$^3$ or less.

Figure 2:
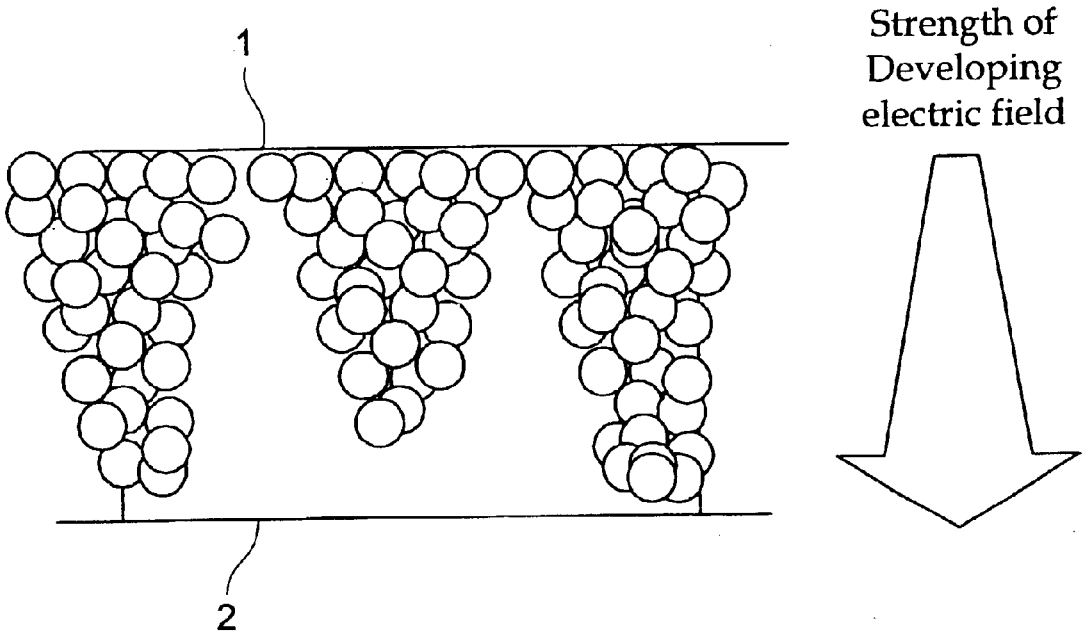
FIG. 2 shows one example of a magnetic brush supplying state around a developing part in a conventional process.

Assumingly, when it is less than 1.3 g/cm$^3$, the magnetic brush gap is large. A magnetic brush shown in FIG. 2 reveals that a toner to be developed is not only at tip end where the developing electric field is strong, but also near the development sleeve where the developing electric field is weak. Therefore, the magnetic brush shown in FIG. 2 is likely to show a significant difference in developing performance due to a carrier resistance.

Figure 1:
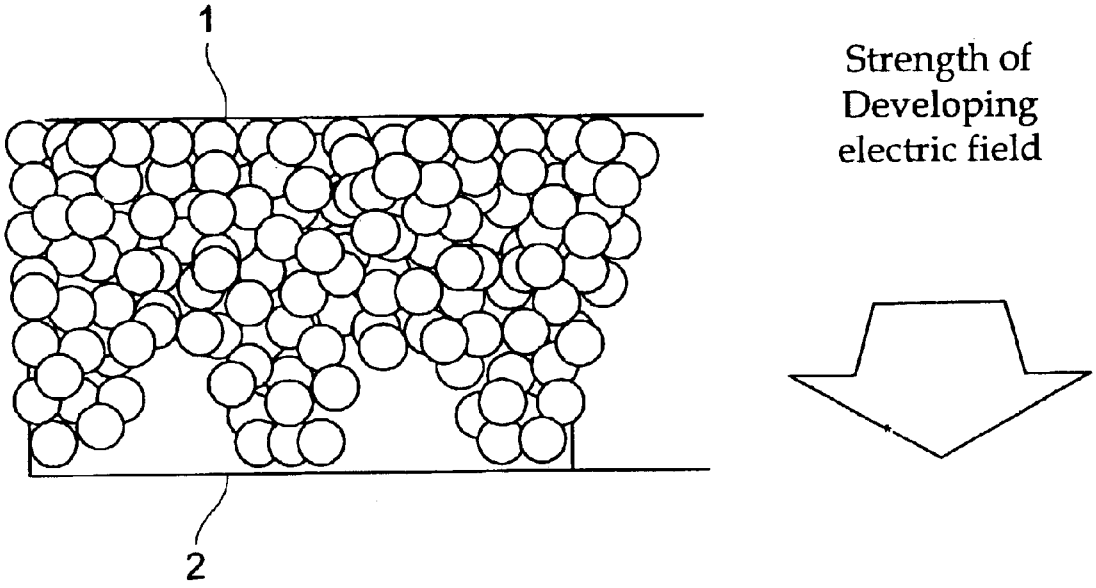
FIG. 1 shows one example of a magnetic brush supplying state around a developing part to high density.

If the developing agent density is increased to 1.3 g/cm$^3$ or more, the magnetic brush gap is supplied as shown in FIG. 1. Accordingly, toners which can be developed concentrates in the vicinity of the latent electrostatic image support 2 where the developing electric field is strong. This apparently makes developing easier. Even if a carrier having high resistance is used, toners are still to be easily developed, and there is less difference in developing performance between carriers having a high resistance and carriers having a low resistance.

However, it also appears that if the developing agent is supplied more densely than 2.0 g/cm$^3$, it becomes too tightly packed, so the magnetic brush gap almost disappears, developing performance deteriorates and the non-uniform image density at the half tone part becomes more apparent.

It is moreover preferred that the developing gap is 0.4 mm or less. The developing agent can be supplied to high density in the developing part by widening the doctor gap and then increasing the introduced amount of the developing agent for a magnetic brush, or by making the developing gap narrow. Herein, the doctor gap refers to a width that determines the amount of a developing agent to be introduced into a development sleeve.

Figure 3:
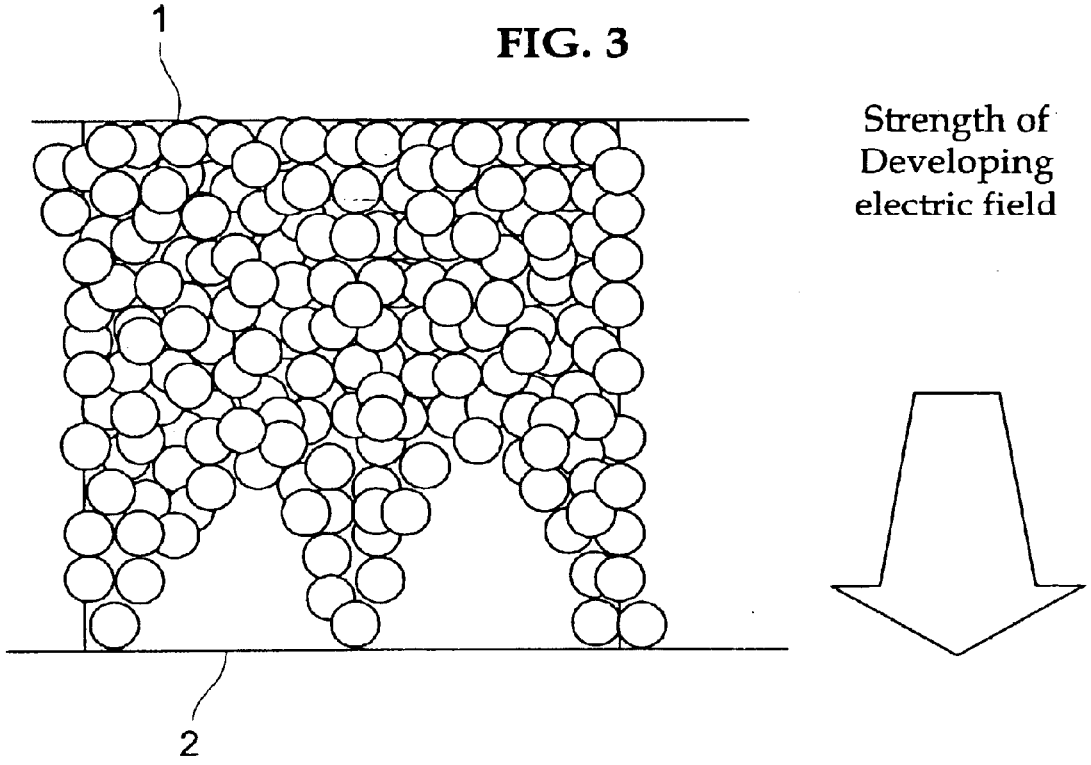
FIG. 3 shows one example of a magnetic brush supplying state around a developing part, which aims to achieve higher density by introducing a larger amount of a developing agent.

FIG. 3 shows one example of a supplying state of a magnetic brush where the magnetic brush is formed by widening the doctor gap, and then introducing more developing agent.

The FIG. 3 shows a similar supplying state to the state of FIG. 1. Having a narrower developing gap in the FIG. 1, the developing electric field is stronger in FIG. 1. The state of FIG. 1 shows less difference in developing performance because of carrier resistance, compared to the case of FIG. 3 where the introduced amount is increased to achieve high density.

It is also preferred to apply an alternating current voltage as the developing agent bias voltage. By applying alternating current, toner is released from the carrier surface more smoothly, toner developing performance is improved, and differences of developing performance due to carrier resistance are smaller than the case where it is not applied.

As described above, differences of developing performance due to fluctuation of carrier resistance are lessened by increasing a density of the developing agent at the developing part. However, with a high density, non-uniform image density at the half tone part becomes apparent, and an abnormal image is produced. Non-uniform image density also becomes apparent in the range of 1.3 g/cm$^3$ to 2.0 g/cm$^3$, which is the density of the present invention. Non-uniform image density is caused by scraping a portion of the toners developed on the photoconductor 2, when a developing agent is supplied in a developing part with a high density, and a plurality of magnetic brushes hence strongly contacts the photoconductor 2.

Attempt is made to make the width at a linearly contacting surface of a plurality of the magnetic brushes narrower in order to have a narrower region for scraping accordingly.

As a result, by narrowing the width at a linearly contacting surface to 2 mm or less, the non-uniform image density at the half tone part was largely improved. However, there is still one part that shows non-uniform image density.

An attempt has been made to obtain a magnetic brush formed of toners and fine carriers, by reducing the carrier particle diameter and by narrowly distributing the carrier particle diameters.

In doing so, more toners are scraped from the photoconductor. The non-uniform image density becomes less apparent, since the toners are scraped uniformly.

The weight average particle diameter for the carriers of the present invention is 25 μm to 45 μm. If it is larger than this, the magnetic brush becomes coarser, and non-uniform image density becomes more apparent, because toners are roughly scraped. The carriers contain 60% by weigh or more, and more preferably 75% by weight or more of carrier particles having a particle diameter of less than 44 μm.

If it is less than 60% by weight, the magnetic brush becomes coarser. Accordingly, toners developed on the latent electrostatic image support as a photoconductor are scraped. As the magnetic brush is formed non-uniformly, a non-uniform image is likely to be produced due to large differences among particle diameters.

However, if the carriers contain 60% by weight or more of the particles, and more preferably 70% by weight or more of the particles, toners developed on the latent electrostatic image support are less likely to be scraped, and a non-uniform image is less likely to be produced accordingly.

The carriers contain 7% by weight or less of particles having a particle diameter of 22 μm or less. If the carriers contain more than 7% by weight of the particles, the magnetic brush is non-uniformly formed. As a result, non-uniform image density becomes more apparent at a half-tone part.

When using the particle having a small diameter, a carrier is more likely to be disposed to a photoconductor because of a smaller magnetic moment per carrier. The carrier deposition refers to a phenomenon in which a carrier itself is disposed to an imaging part or a bare part on a photoconductor. This phenomenon damages a drum or a fixing roller; hence, an abnormal image is produced. In particular, it is found that carriers tend to be disposed more easily when the carrier particle diameter is less than 22 μm. There is no particular problem in the carrier deposition level when the carriers contain 7% by weight or less of carrier particles having a particle diameter smaller than 22 μm. If the carriers contain 3% by weight or less of the carrier particles, the carrier deposition is more effectively prevented. It is more preferable that the carriers contain 1% by weight or less of the carrier particles.

At 1000 Oe (≈79×1000 A/m), when the magnetic moment of the core material is 76 emu/g or more, the carrier deposition is largely improved. However, if it is larger than 100 emu/g, the magnetic brush became coarser, and toners developed on a photoconductor are scraped again. Therefore, the magnetic moment of the core material at 1000 Oe is preferably 76 emu/g to 100 emu/g.

The aforesaid magnetism was measured in the following way.

1.0 g of carrier core particles are packed in a cylindrical cell and placed in an apparatus using a B-H tracer (BHU-60/produced by Riken Denshi Co.,Ltd.). The magnetic field is gradually increased up to 3000 Oe (≈79×3000 A/m). Thereafter, the magnetic field is gradually decreased to zero, and is then gradually increased in other direction up to 3000 Oe. The magnetic field in the other direction is then decreased to zero. Thereafter, the magnetic field is increased in the direction the magnetic field is originally increased. In this way, the B-H curve is obtained, and a magnetic moment at 1000 Oe is calculated.

A bulk density of the carrier is preferably 2.2 g/cm$^3$ or more. A core material having a smaller bulk density is porous, and has a concavoconvex surface. A porous core material substantially has a small magnetic moment per particle, even though it has a large magnetic moment at 1000 Oe. Therefore, the porous core material is disadvantaged with the carrier deposition. A core material having a concavoconvex surface leads to producing carrier particles having different thickness of resin layers. Therefore, the carrier particles are non-uniformly charged, and have non-uniform resistance. Therefore, the core material having a concavoconvex surface is likely to cause the carrier deposition.

There is no particular limitation on the carrier material, and any magnetic particles known in the art may be used. Examples of the carrier material include magnetite, hematite, Li ferrite, Cu—Zn ferrite, Mn—Zn ferrite, Ni—Zn ferrite, Ba ferrite, iron, cobalt, nickel, and the like.

Examples of the core material particles having a magnetic moment of 76 emu/g to 100 emu/g when a magnetic field of 1000 Oe is applied, which is preferably used in the present invention, include magnetite, Mn—Mg—Sr ferrite, Mn ferrite, and the like.

A ratio of a liner velocity (Vr/Vp) refers to a ratio of a liner velocity of a photoconductor (the latent electrostatic image support) (Vp) to a liner velocity of the development sleeve (Vr). The ratio of a liner velocity (Vr/Vp) is preferably 1.2 to 2.2. If the ratio of a liner velocity (Vr/Vp) is more than 2.2, a plurality of magnetic brushes, which touches a latent electrostatic image, is large, and hence requires considerable scraping. Although it does not cause a serious problem, more toners developed on a photoconductor are scraped. On the other hand, if the ratio of a liner velocity (Vr/Vp) is less than 1.2, less toner developed on the photoconductor is scraped. Not a serious problem, however, it causes a poor image density.

In the present invention, a charging amount for a toner is preferably 30 μC/g or less. If the charging amount is more than 30 μC/g, a counter charge becomes larger, hence more carriers are disposed onto a photoconductor, though it does not cause a problem. A minimum charging amount is about 5 μC/g, as low charging amount leads to an abnormal image such as toner deposition on a background of the images, where weakly charged toner are developed onto a non-image-forming portion.

The charging amount is measured by the blow-off method.

There is no particular limitation on the carrier coating layer, which may be any of those known in the art. Examples are polyolefin resins such as polyethylene, polypropylene, polyethylene chloride, chlorosulfonated polyethylene, and the like; polyvinyl and polyvinylidene resins such as polystyrene, acryl (e.g., polymethyl methacrylate), polyacrylonitrile, polyvinyl acetate, polyvinyl alcohol, polyvinylbutyral, polyvinyl chloride, polyvinylcarbazole, polyvinyl ether, polyvinyl ketone, and the like; chloroethylene-vinyl acetate copolymer; silicone resins comprising organosiloxane bonds or modified products thereof (e.g., modified products formed of an alkyde resin, a polyester resin, an epoxy resin, a polyurethane, and the like); perhydropolysilazane or its modified products (including partial oxidation products); fluororesins such as polytetrafluoroethylene, polyvinyl fluoride, polyvinylidene fluoride, polychlorotrifluoroethylene; polyamides; polyesters; polyurethanes; polycarbonates; urea resins; melamine resins; benzoguanamine resins; epoxy resins, and the like.

Of these, examples of suitable coating layer materials for satisfying the criteria of the present invention are silicone resins or their modified products, fluororesins, with silicone resins or their modified products being particularly preferred.

The silicone resin may be any of those known in the related art. Examples include straight silicones comprising only organosiloxane bonds shown in the formula (Formula 1) below, and silicone resins modified by alkydes, polyesters, epoxy compounds, urethanes, and the like.

Formula (1)

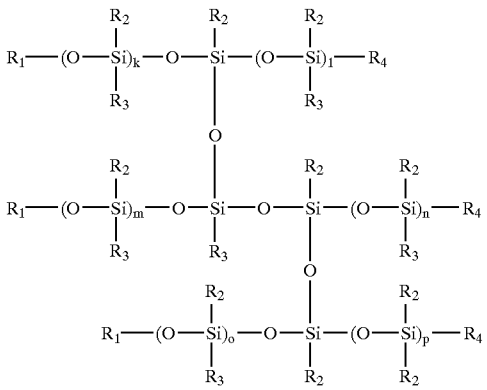

In the Formula (1), $R_1$ is a hydrogen atom, alkyl group with 1 to 4 carbon atoms or a phenyl group, and $R_2$, $R_3$ are hydrogen atoms, alkoxy groups with 1 to 4 carbon atoms, phenyl groups, phenoxy groups, alkenyl groups with 2 to 4 carbon atoms, alkenyloxy groups with 2 to 4 carbon atoms, hydroxyl groups, carboxyl groups, ethylene oxide groups, glycidyl groups or the group shown by the following Formula (2):

Formula (2)

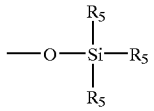

In the Formulae (1) and (2), $R_4$, and $R_5$ are hydroxyl groups, carboxyl groups, alkyl groups having 1 to 4 carbon atoms, alkoxy groups having 1 to 4 carbon atoms, alkenyl groups having 2 to 4 carbon atoms, alkenyloxy groups having 2 to 4 carbon atoms, phenyl groups or phenoxy groups, and "k," "l," "m," "n," "o," and "p" are integers equal to or greater than 1.

The above substituent groups may be non-substituted, or may have substituent groups such as an amino group, a hydroxyl group, a carboxyl group, a mercapto group, an alkyl group, a phenyl group, an ethylene oxide group, a glycidyl group, halogen atoms, and the like.

An additive may be added to the coating solution in order to adjust resistance. Examples of the additive include any known carbon, metal powder such as Al and the like, $SnO_2$ and SnO2 where various kinds of elements are doped, a boride such as such as $TiB_2$, $ZnB_2$, $MoB_2$, and the like, silicon carbide, conductive polymer, and the like.

Coupling agents such as silane coupling agents and titanium coupling agents may also be added as assistants to the carrier core particles and/or coating layer, in order to improve dispersibility or adhesion properties of these resistance control agents.

An example of the silane coupling agents which may be used in the present invention includes a compound expressed by the following Formula (3).

$$YRSiX_3 \qquad \text{Formula (3)}$$

In the Formula (3), X is a hydrolysis group bonded to a silicon atom, such as a chloro group, an alkoxy group, an acetoxygroup, an alkylamino group, a propenoxy group, and the like.

Y is an organic functional group which reacts with an organic matrix, such as a vinyl group, a methacryl group, an epoxy group, a glycidoxy group, an amino group, a mercapto group, and the like. R is an alkyl group or an alkylene group having 1–20 carbon atoms.

Of these silane coupling agents, Y is preferably an aminosilane coupling agent having an amino group in order to obtain a developing agent having negative charge properties. In order to obtain a developing agent having positive charge properties, Y is preferably an epoxy silane coupling agent having an epoxy group.

The image-forming apparatus of the present invention will be described hereinafter.

The image-forming apparatus of the present invention comprises a latent electrostatic image support, a charger which charges the latent electrostatic image support, a light irradiator which irradiates a light to the latent electrostatic image support charged by the charger imagewisely so as to form a latent electrostatic image, a developer which comprises a development sleeve facing the latent electrostatic image support, introduces a developing agent so as to form a plurality of magnetic brushes, provides the developing agent with the latent electrostatic image, and renders the latent electrostatic image visible so as to form a developed image, and a transfer, which transfers the developed image formed by the developer to a transfer medium, wherein the developing agent is supplied with a density of 1.3 g/cm$^3$ to 2.0 g/cm$^3$ at the closest part between the latent electrostatic image support and the development sleeve, the latent electrostatic image support is contacted with a plurality of the magnetic brushes on the development sleeve, so that a plurality of the magnetic brushes have a width of 2 mm or less at a linearly contacting surface, in a direction where the linearly contacting surface of the magnetic brushes rotates, and the developing agent contains toners, and carriers which comprise magnetic core particles and resin layers to cover a surface of the magnetic core particles, the carriers have a weight average particle diameter of 25 $\mu$m to 45 $\mu$m, the carriers contain 60% by weight or more of carrier particles having a particle diameter of less than 44 $\mu$m, and 7% by weight or less of carrier particles having a particle diameter of less than 22 $\mu$m.

Figure 4:
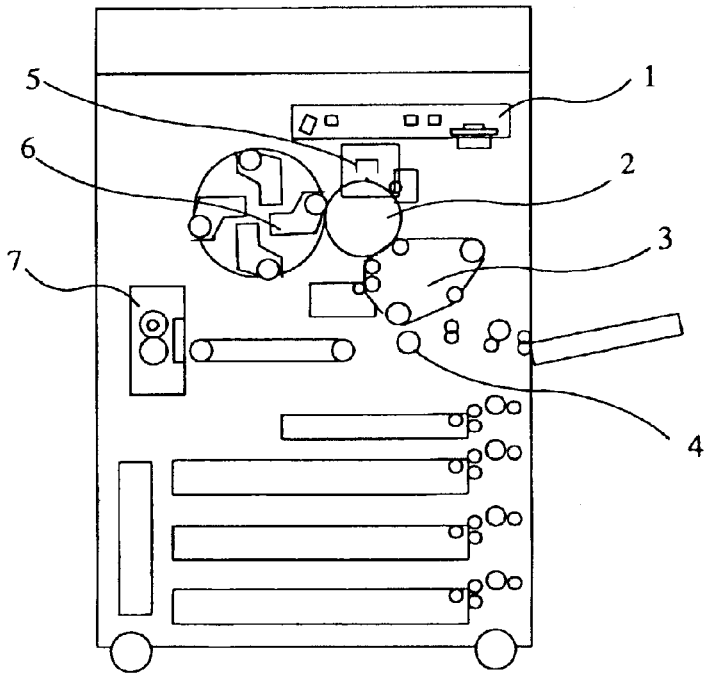
FIG. 4 shows one example of an image-forming apparatus according to the present invention.

FIG. 4 shows one example of an image-forming apparatus according to the present invention. The photoconductor 2 as the latent electrostatic image support is charged by a charger 5 as the charger described above, so as to form a latent electrostatic image on a writing part 1 as the light irradiator. The latent electrostatic image is developed by a developing unit 6 as the developer, the developed image is transferred onto an intermediate transfer belt 3 and then onto a paper medium on a paper transfer roller 4, and is fixed by a fixing unit 7. The doctor gap and developing agent in the developing unit are adjusted so as to have a suitable amount of developing agent to be introduced onto the development sleeve, and the developing gap and the amount of the developing agent which is introduced are adjusted, so as to have the density of developing agent at the closest part between the latent electrostatic image support (the photoconductor) and the development sleeve is adjusted to be 1.3 g/cm$^3$ to 2.0 g/cm$^3$.

The image-forming process cartridge of the present invention comprises a latent electrostatic image support, and a developer which comprises a development sleeve facing the latent electrostatic image support, introduces a developing agent so as to form a plurality of magnetic brushes, provides the developing agent with the latent electrostatic image, and renders the latent electrostatic image visible so as to form a developed image, wherein the process cartridge is formed in a one-piece construction and is attachable to and detachable from an image-forming apparatus, the developing agent is supplied with a density of 1.3 g/cm$^3$ to 2.0 g/cm$^3$ at the closest part between the latent electrostatic image support and the development sleeve, the latent electrostatic image support is contacted with a plurality of the magnetic brushes on the development sleeve, so that a plurality of the magnetic brushes have a width of 2 mm or less at a linearly contacting surface, in a direction where the linearly contacting surface of the magnetic brushes rotates, and the developing agent contains toners, and carriers which comprise magnetic core particles and resin layers to cover a surface of the magnetic core particles, the carriers have a weight average particle diameter of 25 $\mu$m to 45 $\mu$m, the carriers contain 60% by weight or more of carrier particles having a particle diameter of less than 44 $\mu$m, and 7% by weight or less of carrier particles having a particle diameter of less than 22 $\mu$m.

The image-forming process cartridge of the present invention enables providing a stable developing performance toward a carrier resistance, and an image with high quality, by attaching to an image-forming apparatus.

Figure 5:
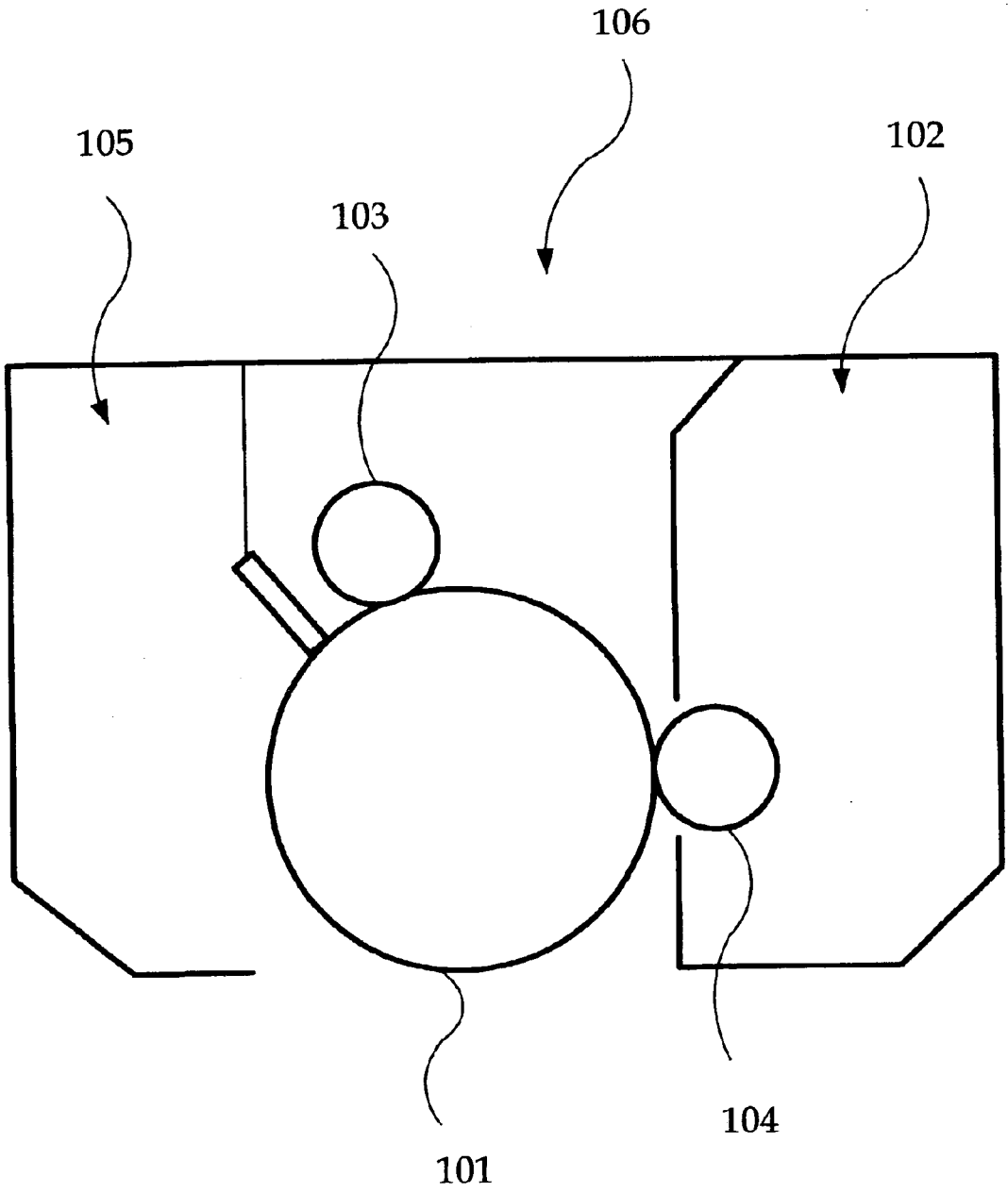
FIG. 5 shows one example of a process cartridge for image-forming according to the present invention.

FIG. 5 shows one example of an image-forming process unit (an image-forming process cartridge) 106. The image-forming process unit 106 comprises a photoconductor drum 101 as the latent electrostatic image support, a charging roller 103 as the charger, a cleaning device 105, and a developing apparatus 102, all of those being formed in a one-piece construction that is attachable to or detachable from a printer. The developing apparatus 102 comprises a development sleeve 104.

EXAMPLES

The present invention will now be described with reference to Manufacturing Examples, Examples and Comparative Examples. Hereinafter, "parts" refers to parts by weight.

Table 1 summarizes the properties of Manufacturing Examples of a carrier.

TABLE 1

| | | | Carrier properties | | | | | | |
|---|---|---|---|---|---|---|---|---|---|
| Carrier manufacturing No. | Carrier name | Core material type | Carrier average weight diameter ($\mu$m) | Weight (%) of particles <44 $\mu$m | Weight (%) of particles <22 $\mu$m | Carrier bulk density (g/cm$^3$) | Core material composition | Core material magnetization at 1 kOe (emu/g) | Aminosilane weight (parts) in coating solution |
| Carrier manufacturing Example 1 | Carrier A | Core material (1) | 35.4 | 60% or more | 7% or less | 2.11 | Cu—Zn ferrite | 61 | 6 parts |
| Carrier manufacturing Example 2 | Carrier B | Core material (2) | 35.2 | 60% or more | 3% or less | 2.11 | Cu—Zn ferrite | 61 | 6 parts |
| Carrier manufacturing Example 3 | Carrier C | Core material (3) | 35.2 | 60% or more | 1% or less | 2.11 | Cu—Zn ferrite | 61 | 6 parts |
| Carrier manufacturing Example 4 | Carrier D | Core material (4) | 35.4 | 75% or more | 5% or less | 2.11 | Cu—Zn ferrite | 61 | 6 parts |
| Carrier manufacturing Example 5 | Carrier E | Core material (5) | 35.2 | 50% or more | 10% or less | 2.11 | Cu—Zn ferrite | 61 | 6 parts |
| Carrier manufacturing Example 6 | Carrier F | Core material (6) | 35.6 | 60% or more | 7% or less | 2.33 | Mn ferrite | 82 | 6 parts |
| Carrier manufacturing Example 7 | Carrier G | Core material (7) | 35.8 | 60% or more | 7% or less | 2.36 | Magnetite | 80 | 6 parts |
| Carrier manufacturing Example 8 | Carrier H | Core material (1) | 35.4 | 60% or more | 7% or less | 2.11 | Cu—Zn ferrite | 61 | 4.5 parts |

Carrier Manufacturing Example 1

Coating solution used:

Straight silicone resin (solids: 20% equivalent): 630 parts

Toluene: 630 parts

Aminosilane: 6 parts

Carbon: 3 parts

The silicone resin solution shown above was coated on 5 kg of core material particles (1) (Cu—Zn ferrite, weight average particle diameter of 35 $\mu$m, and particles having a particle diameter of less than 44 $\mu$m: 60% by weight or more, particles having a particle diameter of less than 22 $\mu$m: 7% by weight or less), at a rate of 30 g/min at 100° C. Thereafter, the product was baked at 250° C. for 120 minutes to obtain a "coated carrier A" having a film thickness of 0.5 $\mu$m.

Manufacturing Example 2

A "carrier B" was obtained in the same way as in Manufacturing Example 1, except that core material particles (2) (identical to core material particles (1) except that the content of particles having a particle diameter of less than 22 $\mu$m was 3% by weight or less), were used.

Manufacturing Example 3

A "carrier C" was obtained in the same way as in Manufacturing Example 1, except that core material particles (3) (identical to core material particles (1), except that the content of particles having a particle diameter of less than 22 $\mu$m was 1% by weight or less), were used.

Manufacturing Example 4

A "carrier D" was obtained in an identical way to that of Manufacturing Example 1, except that core material particles (4) (identical to core material particles (1), except that the content of particles having a particle diameter of less than 44 μm was 75% by weight or more), were used.

Manufacturing Example 5

A "carrier E" was obtained in the same way as in Manufacturing Example 1, except that core material particles (5) (identical to core material particles (1), except that the content of particles having a particle diameter of less than 44 μm was 50% by weight or less, and that the content of particles having a particle diameter of less than 22 μm was 10% by weight or more), were used.

Manufacturing Example 6

A "carrier F" was obtained in the same way as in Manufacturing Example 1, except that core material particles (6) (Mn ferrite, magnetic moment at 1000 Oe, 82 emu/g, bulk density 2.33, weight average particle diameter 35 μm, particles having a particle diameter of less than 44 μm: 60% by weight or more, particles having a particle diameter of less than 22 μm: 7% by weight or less), were used.

Manufacturing Example 7

A "carrier G" was obtained in the same way as in Manufacturing Example 1, except that core material particles (7) (magnetite, magnetic moment at 1000 Oe, 80 emu/g, bulk density 2.36, weight average particle diameter 35 μm, particles having a particle diameter of less than 44 μm: 60% by weight or more, particles having a particle diameter of less than 22 μm: 7% by weight or less), were used.

Manufacturing Example 8

A "carrier H" was obtained in the same way as in Manufacturing Example 1, except that the aminosilane amount of the coating solution was 4.5 parts.

Evaluation Method

A developing agent was prepared by mixing the coating carrier, which was obtained by the above-described Manufacturing Examples, and a black toner for an Imagio 4000 in a weight ratio of 93:7, and then stirring, so as to have a total weight of 700 g.

The developing agent was supplied in a developing unit of the Imagio 4000 color copier. A developing gap, a width at a linearly contacting surface of a plurality of magnetic brushes, and an introduced amount of a developing agent were adjusted according to conditions of the evaluation, using a modified Imagio 4000 color copier.

Figure 6:
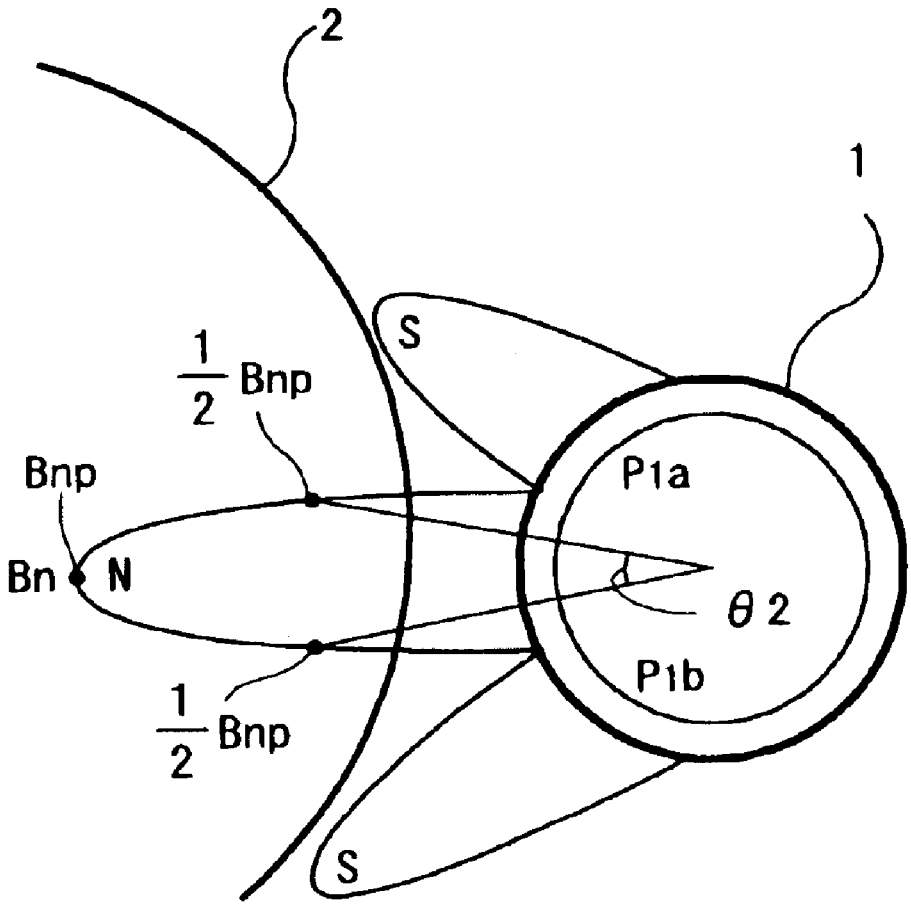
FIG. 6 shows one example of a value of half width according to the present invention.

The width at a linearly contacting surface was adjusted by narrowing a value of half width at the closest part between a development sleeve 1 and a photoconductor 2. Referring into FIG. 6, the value of half width θ2 is expressed as an angle formed by the center of a development sleeve 1, and the points at the half values ½Bnp of the highest value Bnp on the magnetic distribution curve. Development sleeves having values of half width of 38° and 16° were used (a development sleeve having a half width of 16° contributes to a narrower width at a linearly contacting surface).

The width at a linearly contacting surface was measured by the following method. The developing unit was attached to an image-forming apparatus, the developing agent was then stirred in the apparatus. Thereafter, the image-forming apparatus was stopped, and the developing unit was detached from the image-forming apparatus.

A plurality of the magnetic brushes fell down on a part contacted with the photoconductor, when the image-forming apparatus was stopped. The magnetic brushes showed a trace of contacting with a photoconductor. A width at a linearly contacting surface therefore was measured as the width of the trace on a plurality of magnetic brushes.

The developing agent introduced on a development sleeve was adjusting by the doctor gap.

Immediately after having passed the doctor blade, the developing agent introduced onto an area of 2.2 cm (a length in a longer direction of development sleeve)×1 cm (a length in a direction where the development sleeve rotates) on the development sleeve was attracted by a magnet. The weight of the developing agent, which was attracted by a magnet, was then measured. The weight was divided by the area of 2.2 $cm^2$ on the development sleeve.

The amount of the introduced developing agent was measured at three areas on the development sleeve. The three areas include a center of the development sleeve, and both of the right end and the left end on the development sleeve, where the development sleeve is seen from a longer direction. The present invention employed the average amount calculated from the amounts of the introduced developing agent at the three areas.

(i) Change in carrier resistance over time

The initial carrier resistance and carrier resistance after running, were measured.

Carriers were supplied into a container made of fluorinated resin which accommodates two electrodes having a specific surface of 2×4 cm, and a distance between the electrodes of 2 mm. 500V of a direct current voltage was then applied between the electrodes. Thereafter, a direct current resistance was measured by a high resistance meter (Model 4329A, manufactured by Yokokawa Hewlett Packard, Inc.), and a rate of the electrical resistance, LogR (Ω.cm), was calculated.

(ii) Change in image density over time

The image density of a solid image was measured so as to examine the change of the developing performance of the developing agent over time. Gray Scale produced by Eastman Kodak Company was copied, and five parts on a center of a solid image which has the lowest lightness was measured by an X-Rite 938 spectral side color density meter, and the average amount of the five parts were calculated. Image density was measured by producing images both at an initial phase and after 100K running.

(iii) Evaluation of non-uniform image density at half tone part

Eastman Kodak Company's Gray Scale copies were made, and the non-uniform image density at the half tone image part fifth from the highest lightness was evaluated on an initial image. For the evaluation, ranking samples were prepared and visually evaluated according to the following criteria:

Rank 5: Very good image without any non-uniform image density

Rank 4: Good image with little non-uniform image density

Rank 3: Image with slight non-uniform density, but presenting no problem in practice Rank 2: Image having some parts with marked non-uniform image density Rank 1: Image with marked non-uniform image density (iv) Carrier deposition test Developing of a bare part was performed by fixing the developing agent bias voltage (Vb) at DC=−500V, varying the charging potential (Vd) to −650V, −800V, −950V, and observing the carrier adhering to the drum prior to transfer. The power was switched off before transfer to paper was complete, the latent electrostatic image support 2 was removed, and the amount of disposed carriers was observed.

Herein, the bare potential is Vb-Vd. The larger this value is, the more easily carrier deposition occurs. In the present evaluation, considering that various conditions might be obtained in practice, bare potentials were applied up to a considerably high value.

The following ranking was made according to the carrier deposition state for each bare potential. In all of the cases, carrier deposition was evaluated for a developing agent at an initial phase.

Rank 5: Carrier deposition does not easily occur even if a strong bare potential is applied, and there is a very high tolerance to carrier deposition.

Rank 4: Slight adhesion is observed if a strong bare potential is applied, but there is a high tolerance to carrier deposition.

Rank 3: Some carrier deposition is observed if a strong bare potential is applied, but in normal use, there is sufficient tolerance to carrier deposition.

Rank 2: If the bare potential normally used is applied, there is not much carrier deposition, but if a strong bare potential is applied, it rapidly increases and tolerance to carrier deposition declines.

Rank 1: Carrier deposition easily occurs even with a weak bare potential, so there are problems in normal use and tolerance to carrier deposition deteriorates.

Table 2 summarizes the Examples and Comparative Examples.

TABLE 2

| | Developing process | | | | | | | | Test item | | | | | | |
|---|---|---|---|---|---|---|---|---|---|---|---|---|---|---|---|
| | Carrier used | Charging amount ($\mu$C/g) | Developing part developing agent density (g/cm$^3$) | Developing gap (mm) | Introduced developing agent (g/cm$^2$) | Main electrode value of half width (degrees) | AC voltage applied | Linear velocity ratio of photoconductor and development sleeve | Carrier DC resistance value (initial) | Carrier DC resistance value (after 100 K running) | Black solid image density (initial) | Black solid image density (after 100 K running) | Black solid image density variation amount (after 100 K running-initial) | Ranking of non-uniform image density at half tone part | Carrier deposition ranking |
| Ex. 1 | Carrier A | 32 | 1.5 | 0.4 | 0.06 | 16 | ○ | 2.4 | 14.8 | 11.5 | 1.64 | 1.73 | 0.09 | 3 | 3 |
| Comp. Ex. 1 | Carrier A | 32 | 1.5 | 0.4 | 0.06 | 38 | ○ | 2.4 | 14.8 | 11.4 | 1.75 | 1.84 | 0.09 | 2 | 2 |
| Comp. Ex. 2 | Carrier A | 31.9 | 1 | 0.6 | 0.06 | 16 | ○ | 2.4 | 14.8 | 11.7 | 1.62 | 1.96 | 0.34 | 4.5 | 4 |
| Comp. Ex. 3 | Carrier A | 32.3 | 2.2 | 0.3 | 0.068 | 16 | ○ | 2.4 | 14.8 | 11.2 | 1.54 | 1.58 | 0.04 | 1 | 3 |
| Ex. 2 | Carrier A | 32.1 | 1.51 | 0.55 | 0.083 | 16 | ○ | 2.4 | 14.8 | 11.5 | 1.7 | 1.81 | 0.11 | 3 | 3 |
| Ex. 3 | Carrier A | 32 | 1.5 | 0.4 | 0.06 | 16 | x | 2.4 | 14.8 | 11.6 | 1.43 | 1.56 | 0.13 | 2 | 3 |
| Ex. 4 | Carrier B | 31.8 | 1.5 | 0.4 | 0.06 | 16 | ○ | 2.4 | 14.5 | 11.3 | 1.66 | 1.74 | 0.08 | 4 | 4 |
| Ex. 5 | Carrier C | 31.6 | 1.5 | 0.4 | 0.06 | 16 | ○ | 2.4 | 14.6 | 11.4 | 1.66 | 1.72 | 0.06 | 5 | 5 |
| Ex. 6 | Carrier D | 32.2 | 1.5 | 0.4 | 0.06 | 16 | ○ | 2.4 | 14.6 | 11.6 | 1.67 | 1.71 | 0.04 | 4 | 3 |
| Comp. Ex. 4 | Carrier E | 32.4 | 1.5 | 0.4 | 0.06 | 16 | ○ | 2.4 | 14.7 | 11.5 | 1.6 | 1.82 | 0.22 | 1 | 1 |
| Ex. 7 | Carrier F | 32.1 | 1.5 | 0.4 | 0.06 | 16 | ○ | 2.4 | 14.6 | 11.4 | 1.66 | 1.75 | 0.09 | 3 | 4 |
| Ex. 8 | Carrier G | 32.1 | 1.5 | 0.4 | 0.06 | 16 | ○ | 2.4 | 14.5 | 11.5 | 1.67 | 1.75 | 0.08 | 3 | 5 |
| Ex. 9 | Carrier A | 32 | 1.5 | 0.4 | 0.06 | 16 | ○ | 1.1 | 14.8 | 11.4 | 1.46 | 1.57 | 0.11 | 4 | 3.5 |
| Ex. 10 | Carrier A | 32.1 | 1.5 | 0.4 | 0.06 | 16 | ○ | 1.8 | 14.8 | 11.3 | 1.68 | 1.78 | 0.1 | 3.5 | 3.5 |
| Ex. 11 | Carrier H | 27.5 | 1.5 | 0.4 | 0.06 | 16 | ○ | 2.4 | 14.5 | 11.4 | 1.58 | 1.69 | 0.11 | 3 | 3.5 |

Example 1

Using the carrier A, the development sleeve 1 wherein the value of half width of the main electrode was 16°, was employed in a process where the developing agent density at the developing part was 1.5 g/cm$^3$, the introduced amount of the developing agent was 0.06 g/cm$^2$, the developing gap was 0.4 mm and the linear velocity ratio (Vr/Vp) was 2.4.

When the width at a linearly contacting surface was measured under these experimental conditions, it was found to be 2 mm. When the developing agent on the development sleeve was sampled, and the charge amount was measured by the blow-off method, it was found to be 32 $\mu$C/g.

Comparative Example 1

A test was performed under the same conditions as in Example 1, except that the development sleeve 1 was used where the value of half width of the main electrode was 38°. The same procedure as Example 1 was followed, except that the width at a linearly contacting surface was widened to 4 mm.

It was found that, compared to Example 1, the non-uniform image density at the half tone part and carrier deposition were far worse.

Comparative Example 2

A test experiment was performed wherein the same introduced amount of the developing agent as 0.06 g/cm$^2$, but the developing gap was widened to 0.6 mm and the developing agent density was decreased to 1.00 g/cm$^3$, using an identical carrier A to that of Example 1.

Comparing the change in image density of a solid image with that of Example 1, it was found that, in Example 1, the image density varied to 0.09 due to 100K running, that in Comparative Example 2, the imagine density varied to 0.34, and that, in Comparative Example 2, the developing performance largely varied over time.

Comparative Example 3

The introduced amount of the developing agent was increased to 0.068 g/cm$^2$ by adjusting the doctor gap, the developing gap was narrowed to 0.3 mm, and the developing agent density was increased to 2.2 g/cm$^3$, using an identical carrier A to that of Example 1. Comparing the image density variation of a solid image with that of Example 1, in Comparative Example 3, the image density was varied relatively slightly over time, however, the image density of the solid image decreased, and the non-uniform image density at the half tone part was extremely apparent.

Example 2

A test experiment was performed by a process with a substantially effectively identical developing agent density to that of Example 1, 1.51 g/cm$^3$, wherein the developing gap was widened to 0.55 mm, and the introduced amount was 0.083 g/cm$^2$, using an identical carrier A to that of Example 1. When the width at a linearly contacting surface was measured under these experimental conditions, it was found to be 2 mm.

Compared to Example 1, the developing agent density was identical, but the image density of a solid image of Example 1 varied relatively slightly where the developing gap was narrower.

Example 3

A test experiment was performed in the same process as in Example 1, except that an alternating current voltage was not applied as the developing bias voltage, using an identical carrier A to that of Example 1.

Compared to Example 1, the image density of a solid image was lower in the Example 3, and the image density largely varied over time.

Example 4

A test experiment was performed in the same developing process conditions as in Example 1, using a carrier B, which is different from the carrier A used in Example 1 in that the content of particles having a particle diameter of less than 22 $\mu$m was reduced to 3% by weight or less.

Compared to Example 1, in Example 4, the non-uniform image density at a half tone part was further improved and the tolerance to carrier deposition was also improved.

Example 5

A test experiment was performed in the same developing process conditions as in Example 1, using a carrier C, which is different from the carrier A used in Example 1 in that the content of particles having a particle diameter of less than 22 $\mu$m was reduced to 1% by weight or less.

Very good results were obtained for non-uniform image density and tolerance to carrier deposition, which represented an improvement over Examples 1 and 4.

Example 6

A test experiment was performed in the same developing process as in Example 1 using a carrier D, which is different from the carrier A used in Example 1 in that the content of particles having a particle diameter of less than 44 $\mu$m was increased to 75% by weight or more.

Compared to Example 1, the non-uniform image density at the half tone part was further improved, and the image density of a solid image varied rather largely over time.

Comparative Example 4

A test experiment was performed in the same developing process conditions as Example 1, using a carrier E having a wider particle diameter distribution than that of carrier A, which was identical to the carrier A used in Example 1 in that the weight average particle diameter was 35 $\mu$m, but different in that the content of particles having a particle diameter of less than 44 $\mu$m was 50% by weight or more and the content of particles having a particle diameter of less than 22 $\mu$m was 10% by weight or more.

Compared to Example 1, the non-uniform image density at the half tone part was apparent, and carrier deposition was more likely to be caused. The image density of a solid image varied largely over time.

Example 7

A test experiment was performed in the same developing process conditions as in Example 1, using a carrier F formed of a core material of Mn ferrite instead of Cu—Zn ferrite of Example 1 Compared to the carrier A, the carrier F had a higher magnetic moment at 1000 Oe, and its bulk density was higher.

Compared to Example 1, the carrier deposition ranking was improved, and the tolerance to carrier deposition increased.

Example 8

A test experiment was performed in the same developing process conditions as Example 1, using a carrier G formed of a core material of magnetite instead of Cu—Zn ferrite as of Example 1. The carrier G had a large magnetic moment at 1000 Oe, and its bulk density was high.

The carrier G had the carrier deposition ranking of 5, which was extremely good, and the tolerance to carrier deposition was improved compared to Example 1.

Example 9

A test experiment was performed in the same developing process conditions as in Example 1, using an identical carrier A to that of Example 1, except that the linear velocity ratio (Vr/Vp) of the photoconductor and the development sleeve was reduced to 1.1. The initial image density was 1.46, which was a lower than that of Example 1.

Example 10

A test experiment was performed in the same developing process conditions as in Example 1, using an identical carrier A to that of Example 1, except that the linear velocity ratio (Vr/Vp) was reduced to 1.8. While the non-uniform image density at the half tone part was ranked as 3.0 in Example 1, it increased to 3.5 in Example 10.

Example 11

A test experiment was performed in the same developing process conditions as in Example 1, using carrier H having a lower aminosilane amount in the coating layer than that of carrier A. While the charging amount was 32 $\mu$C/g in Example 1, it was 27.5 $\mu$C/g in Example 11. Compared to Example 1, the tolerance to carrier deposition was improved.

The present invention provides a process for developing, where a developing performance is less likely to become affected by carrier resistance, and is stabilized over time, by determining a density of a developing agent at a developing part to 1.3 g/cm$^3$ to 2.0 g/cm$^3$. The present invention also provides a process for developing and an image-forming apparatus, where a width at a linearly contacting surface is 2 mm or less, the carriers of a developing agent have a weight average particle diameter of 25 $\mu$m to 45 $\mu$m, the carriers contain 60% by weight or more of the carrier particles having a particle diameter of less than 44 $\mu$m, and 7% by weight or less of carrier particles having a particle diameter of less than 22 $\mu$m. The process of the present invention and the image-forming apparatus of the present invention enable good imaging properties without producing abnormal images such as scraping of toners, in spite of a high density of a developing agent.

What is claimed is:

1. A process for developing comprising the step of:

developing a latent electrostatic image on a latent electrostatic image support by a developing agent supplied on a development sleeve, wherein the developing agent is supplied with a density of 1.3 g/cm$^3$ to 2.0 g/cm$^3$ at the closest part between the latent electrostatic image support and the development sleeve, the latent electrostatic image support is contacted with a plurality of magnetic brushes formed of the developing agent on the development sleeve, so that a plurality of the magnetic brushes have a width of 2 mm or less at a linearly contacting surface, in a direction where the linearly contacting surface of the magnetic brushes rotates, and the developing agent contains toners, and carriers which comprise magnetic core particles and resin layers to cover a surface of the magnetic core particles, the carriers have a weight average particle diameter of 25 $\mu$m to 45 $\mu$m, the carriers contain 60% by weight or more of the carrier particles having a particle diameter of less than 44 $\mu$m, and 7% by weight or less of carrier particles having a particle diameter of less than 22 $\mu$m.

2. A process for developing according to claim 1, wherein a developing gap is 0.4 mm or less, when the developing gap expresses a distance at the closest part between the latent electrostatic image support and the development sleeve.

3. A process for developing according to claim 1, further comprising the step of:

applying an alternating current voltage as a developing agent bias voltage.

4. A process for developing according to claim 1, wherein the density of the developing agent is 1.3 g/cm$^3$ to 1.7 g/cm$^3$, at the closest part between the latent electrostatic image support and the development sleeve.

5. A process for developing according to claim 1, wherein the carriers contain 75% by weight or more of the carrier particles having a particle diameter of less than 44 $\mu$m.

6. A process for developing according to claim 1, wherein the carriers contain 3% by weight or less of the carrier particles having a particle diameter of less than 22 $\mu$m.

7. A process for developing according to claim 6, wherein the carriers contain 1% by weight or less of the carrier particles having a particle diameter of less than 22 $\mu$m.

8. A process for developing according to claim 1, wherein the magnetic core particles have a magnetic moment of 76 emu/g to 100 emu/g, in a magnetic field of 1000 Oe.

9. A process for developing according to claim 8, wherein the magnetic core particles are one of Mn—Mg—Sr ferrite, Mn ferrite, and magnetite.

10. A process for developing according to claim 1, wherein the carriers have a bulk density of 2.2 g/cm$^3$ or more.

11. A process for developing according to claim 1, wherein a ratio of a liner velocity (Vp) of the latent electrostatic image support to a liner velocity of the development sleeve (Vr) satisfies a relation of $1.2<(Vr/Vp)<2.2$.

12. A process for developing according to claim 1, wherein the toners have a charging amount of 30 $\mu$C/g or less.

13. A process for developing according to claim 1, wherein the resin layers of the carrier particles contain a silicone resin and an aminosilane coupling agent.

14. An image-forming apparatus, comprising:

a latent electrostatic image support;

a charger which charges the latent electrostatic image support;

a light irradiator which irradiates a light to the latent electrostatic image support charged by the charger imagewisely so as to form a latent electrostatic image;

a developer which comprises a development sleeve facing the latent electrostatic image support, introduces a developing agent so as to form a plurality of magnetic brushes, provides the developing agent with the latent electrostatic image, and renders the latent electrostatic image visible so as to form a developed image; and a transfer, which transfers the developed image formed by the developer to a transfer medium, wherein the developing agent is supplied with a density of 1.3 g/cm$^3$ to 2.0 g/cm$^3$ at the closest part between the latent electrostatic image support and the development sleeve;

the latent electrostatic image support is contacted with a plurality of the magnetic brushes on the development sleeve, so that a plurality of the magnetic brushes have a width of 2 mm or less at a linearly contacting surface, in a direction where the linearly contacting surface of the magnetic brushes rotates, and the developing agent contains toners, and carriers which comprise magnetic core particles and resin layers to cover a surface of the magnetic core particles, the carriers have a weight average particle diameter of 25 μm to 45 μm, the carriers contain 60% by weight or more of carrier particles having a particle diameter of less than 44 μm, and 7% by weight or less of carrier particles having a particle diameter of less than 22 μm.

15. An image-forming apparatus according to claim 14, wherein the developing gap is 0.4 mm or less.

16. An image-forming process cartridge, comprising:

a latent electrostatic image support; and a developer which comprises a development sleeve facing the latent electrostatic image support, introduces a developing agent so as to form a plurality of magnetic brushes, provides the developing agent with the latent electrostatic image, and renders the latent electrostatic image visible so as to form a developed image, wherein the process cartridge is formed in a one-piece construction and is attachable to and detachable from an image-forming apparatus;

the developing agent is supplied with a density of 1.3 $g/cm^3$ to 2.0 $g/cm^3$ at the closest part between the latent electrostatic image support and the development sleeve;

the latent electrostatic image support is contacted with a plurality of the magnetic brushes on the development sleeve, so that a plurality of the magnetic brushes have a width of 2 mm or less at a linearly contacting surface, in a direction where the linearly contacting surface of the magnetic brushes rotates, and the developing agent contains toners and carriers which comprise magnetic core particles and resin layers to cover a surface of the magnetic core particles, the carriers have a weight average particle diameter of 25 μm to 45 μm, the carriers contain 60% by weight or more of carrier particles having a particle diameter of less than 44 μm, and 7% by weight or less of carrier particles having a particle diameter of less than 22 μm.

17. An image-forming process cartridge according to claim 16, wherein the developing gap is 0.4 mm or less.

* * * * *